US005321948A

United States Patent [19]

Leonard

[11] Patent Number: 5,321,948

[45] Date of Patent: Jun. 21, 1994

[54] FUEL STAGED PREMIXED DRY LOW $NO_x$ COMBUSTOR

[75] Inventor: Gary L. Leonard, Cincinnati, Ohio

[73] Assignee: General Electric Company, Schenectady, N.Y.

[21] Appl. No.: 75,358

[22] Filed: Jun. 14, 1993

Related U.S. Application Data

[63] Continuation of Ser. No. 766,865, Sep. 27, 1991, abandoned.

[51] Int. Cl.[5] ..... F02C 1/00

[52] U.S. Cl. ..... 60/737; 60/747

[58] Field of Search ..... 60/732, 733, 737, 738, 60/746, 747, 752, 755, 757, 39.06

[56] References Cited

U.S. PATENT DOCUMENTS

| | | | |
|---|---|---|---|
| 2,417,445 | 1/1947 | Pinkel . | |
| 2,680,951 | 6/1954 | Winter | 60/752 |
| 3,338,051 | 8/1967 | Chamberlain et al. . | |
| 3,811,277 | 5/1974 | Markowski | 60/733 |
| 4,112,676 | 9/1978 | DeCorso | 60/737 |
| 5,054,280 | 10/1991 | Ishibashi | 60/39.06 |
| 5,069,029 | 12/1991 | Koroda et al. | 60/39.06 |
| 5,121,597 | 6/1992 | Urushidani et al. | 60/733 |

FOREIGN PATENT DOCUMENTS

| | | | |
|---|---|---|---|
| 61-052522 | 7/1986 | Japan . | |
| 0183720 | 7/1990 | Japan | 60/737 |
| 638109 | 5/1950 | United Kingdom . | |

OTHER PUBLICATIONS

"Low Emission Combustor Design Options For An Aero Derived Industrial Gas Turbine" Owen et al., Canadian Gas Association Symposium on Industrial Application of Gas Turbines, Oct. 1991.

*Primary Examiner*—Richard A. Bertsch
*Assistant Examiner*—William Wicker
*Attorney, Agent, or Firm*—Paul R. Webb, II

[57] ABSTRACT

This invention relates to fuel staged premixed dry low $NO_x$ gas turbine combustors of the type that are constructed with multiple concentric cylinders to which fuel manifolds are mounted. The cylinders are spaced in a staggered arrangement. Such structures of this type achieve stable combustion over a wide range of fuel-to-air ratios and low flame temperature in the combustor resulting in low emissions of nitrogen oxides ($NO_x$).

4 Claims, 1 Drawing Sheet

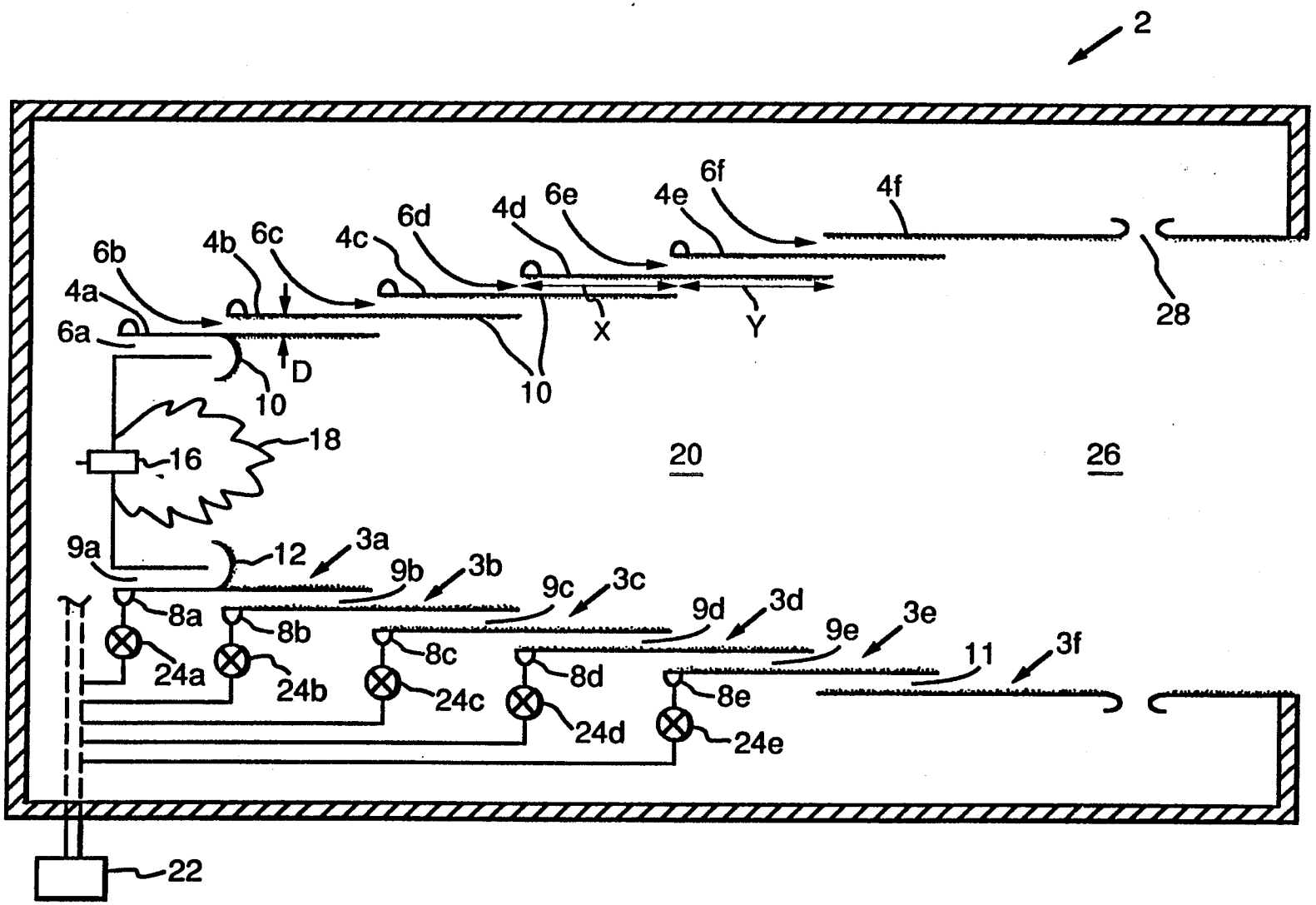
2
28
26
20
4f
6f
4e
6e
4d
6d
4c
6c
4b
6b
4a
6a
Y
X
10
D
18
16
12
9a
3a
9b
3b
9c
3c
9d
3d
9e
3e
3f
11
8a
8b
8c
8d
8e
24a
24b
24c
24d
24e
22

FUEL STAGED PREMIXED DRY LOW $NO_x$ COMBUSTOR

This application is a continuation of application Ser. No. 07/766,865, filed Sep. 27, 1991, now abandoned.

BACKGROUND OF THE INVENTION

1. Field of the Invention

This invention relates to fuel staged premixed dry low $NO_x$ gas turbine combustors of the type that are constructed with multiple concentric cylinders to which fuel manifolds are mounted. The cylinders are spaced in a staggered arrangement. Such structures of this type achieve stable combustion over a wide range of fuel-to-air ratios and low flame temperatures in the combustor resulting in low emissions of nitrogen oxides and carbon monoxide($NO_x$ and CO, respectively).

2. Description of the Related Art

It is known, in combustor systems, that in order to reduce $NO_x$ emissions, the flame temperature in the combustor must be reduced. A well known method of reducing the flame temperature is to premix the fuel and the air prior to the mixture being combusted. However, it is also known that a premixed combustor, typically, runs over a relatively narrow operation window which is determined by lean blow-out at low fuel/air ratios and high $NO_x$ emissions at high fuel/air ratios. Flame stability is very sensitive to the fuel-to-air ratio and the fuel/air velocity. For example, if the velocity of the mixture is too high, the flame in the combustor can be blown out. But, if the velocity is too low, the combustor flame may propagate backwards into the premixing area which is commonly referred to as flashback. Also, if the fuel-to-air ratio is not properly maintained and the flame temperature gets too high, the amount of $NO_x$ created will increase which is also highly undesirable. Therefore, a more advantageous premixed low $NO_x$ combustor, then, would be presented if the combustor could be run over a larger operating window. This is particularly important with regard to the operating range of the gas turbine.

It is apparent from the above that there exists a need in the art for a premixed low $NO_x$ combustor which is efficient through simplicity of parts and uniqueness of structure, and which at least equals the $NO_x$ emissions characteristics of known premixed combustors, but which at the same time can be run over a larger operating window. It is a purpose of this invention to fulfill this and other needs in the art in a manner more apparent to the skilled artisan once given the following disclosure.

SUMMARY OF THE INVENTION

Generally speaking, this invention fulfills these needs by providing a fuel staged premixed dry low $NO_x$ combustor, comprising a fuel introduction means, an air introduction means, a combustion chamber means, a spark means located substantially within said combustion chamber, and at least two concentric cylinders located in a staggered arrangement with respect to each other such that said cylinders overlap for a predetermined distance to create fuel and air mixing means.

In certain preferred embodiments, the fuel and air mixing means is sufficiently long enough to allow good mixing and also serves to cool the liner of combustion chamber prior to the fuel/air mixture being admitted into the combustion chamber. Also, the fuel and air mixing means is sufficiently long enough so that substantially all of the fuel in the fuel/air mixture is consumed before the remaining mixture combines with the flow of the adjacent fuel/air mixing means.

In another further preferred embodiment, the combustor is run over a larger operating window which maintains the flame temperature at a relatively low value over a larger range of fuel-to-air conditions which, in turn, provide low $NO_x$ emissions for this larger range of conditions while providing adequate cooling to the combustion chamber liner.

The preferred fuel staged premixed combustor, according to this present invention, offers the advantages of improved heat transfer and very low $NO_x$ emissions while achieving flame stability over a wide operating window.

BRIEF DESCRIPTION OF THE DRAWING

The above and other features of the present invention which will become more apparent as the description proceeds are best understood by considering the following detailed description in conjunction with the accompanying drawing, in which:

The single FIGURE is a side plan view of a fuel staged premixed dry low $NO_x$ combustor, according to the present invention.

DETAILED DESCRIPTION OF THE INVENTION

With reference to the single FIGURE, there is illustrated fuel staged premixed dry low $NO_x$ combustor 2. Combustor 2 is rigidly attached by conventional fasteners (not shown) to a conventional pressurized vessel (not shown) such that the pressurized vessel substantially encloses combustor 2 except for combustion chamber exit zone 26. The pressurized vessel provides a relatively constant pressure air source for combustor 2 through a conventional air pressurizing apparatus. Combustor 2 is constructed, in part, with outer shells **4*a*–4*f* of staggered concentric cylinders 3*a*–3*f*. Shells 4*a*–4*f*, preferably, are constructed of Hastelloy X alloy manufactured by International Nickel Company in Huntington, W. Va. Shells 4*a*–4*f* also include a thin, heat resistant thermal barrier 10, preferably, constructed of partially stabilized zirconia having a thickness of approximately 0.030 inches which is applied to the inside surfaces of shells 4*a*–4*f*** by conventional coating techniques, such as plasma spraying.

Shells **4*a*–4*f* include air control passages 6*a*–6*f* and air dilution holes 28. Passages 6*a*–6*e* and holes 28 are used to admit air into combustion chamber 20 and cool cylinders 3*a*–3*f*. The air, typically, is introduced in passages 6*a*–6*e* and holes 28** at a temperature of approximately 600°–1000° F.

A conventional gaseous fuel such as natural gas is introduced into combustor 2 by conventional fuel manifolds **8*a*–8*e*. Manifolds 8*a*–8*e* are connected by conventional connectors to shut off valves 24*a*–24*e*, respectively. Valves 24*a*–24*e* are connected by conventional connectors to a conventional fuel header 22. Air which is introduced by control passages 6*a*–6*f* and fuel which is introduced by manifolds 8*a*–8*e* are mixed in annular fuel/air premixing passages 9*a*–9*e*, respectively. Premixing passages 9*a*–9*e***, preferably, are constructed such that the flow length (X) is sufficiently long enough to allow good mixing of the fuel and air. Preferably, the ratio of X to the annular gap (D) is approximately equal to 10 to provide proper mixing. Also, the distance (Y)

preferably, should be long enough so that substantially all of the fuel is consumed before mixing with the fuel/air mixture flow of the next passage. The ratio of Y to D is approximately equal to 10 to allow for sufficient combustion. Finally, the fuel/air mixture flowing in passages 9a–9e and passage 11 serves to cool the surfaces of cylinders 3a–3f which are exposed to hot combustion products prior to being admitted to combustion chamber 20. The flow through passage 11 is mainly constituted of an air flow which serves to cool cylinder 3f. Passage 9a also includes a curved counterflow vane 12. Vane 12, preferably, is constructed of Hastelloy ®X and is coated with barrier 10. Vane 12 is used to create a counterflow region for mixing the fuel and air. The fuel/air mixture is ignited by a conventional spark igniter 16. This counterflow of the fuel/air mixture assures a stable lean flame.

During full power operation, fuel is going to the passages 9a–9e. The fuel-to-air ratio in all passages is adjusted to produce a flame temperature of between 2600° and 3000° F. thus giving low $NO_x$ and low CO. As turbine power requirements drop the fuel flow to passages 9a–9e is reduced to the point at which the flame temperature equals approximately 2600° F. If the fuel flow is further reduced, incomplete combustion and high CO would result. Therefore, fuel air is shut off completely to manifold 8e and the resulting fuel-to-air ratio in passages 9a–9d increases giving a flame temperature near 3000° F. from those zones which remain fueled. As power is further reduced the fuel flow to manifolds 8a–8d is cut back until the resulting flame temperature is reduced to near 2600° F. at which point the fuel is shut off completely to manifold 8d. In this manner, power is reduced by sequentially cutting fuel flow off to manifolds 8b and 8c. The flame temperature is maintained between 2600° and 3000° F. thus giving low $NO_x$ and CO over the turbine operating range. Manifold 8a always has fuel going to it and a fuel to air mixture is presented to flame zone 18 of the combustor where it burns and forms a pilot flame. This flame 18 subsequently ignites downstream fuel/air mixtures from passages which are fueled. The premixed fuel and air flame in zone 18 can be stabilized by any number of means including swirl, bluff body and forced recirculation (shown in FIG. 1 via vane 12). It is important not to turn fuel off to zones upstream of zones which are fueled. This could cause quenching of the fuel and air mixture from the downstream fueled passages and incomplete combustion and high CO.

Once given the above disclosure, many other features, modifications or improvements will become apparent to the skilled artisan. Such features, modifications or improvements are, therefore, considered to be apart of this invention, the scope of which is to be determined by the following claims.

What is claimed is:

1. A fuel staged premixed low $NO_x$ combustor, said combustor comprised of:

a fuel introduction means;

an air introduction means;

a combustion chamber means;

a spark means located substantially within said combustion chamber means; and at least three concentric cylinders located in a staggered arrangement with respect to each other such that said cylinders overlap to create a plurality of fuel and air mixing means of predetermined lengths wherein each of said concentric cylinders is further comprised of a fuel combustion zone of a predetermined distance and wherein said concentric cylinders are further comprised of:

a gap of predetermined width between each of said cylinders such that a ratio of said predetermined lengths of said fuel and air mixing means to said gap widths and air mixing means is approximately equal to 10.

2. The combustor, according to claim 1, wherein said fuel introduction means is further comprised of:

a fuel header means;

a valve means; and a fuel manifold means.

3. The combustor, according to claim 1, wherein a ratio of said distances of said fuel combustion zones to said gap widths is approximately equal to 10.

4. The combustor, according to claim 1, wherein fuel and air mixing means are further comprised of:

a flow recirculation means located adjacent said spark means.

* * * * *